US005799457A

United States Patent [19]

Schumacher et al.

[11] Patent Number: 5,799,457

[45] Date of Patent: Sep. 1, 1998

[54] STRUCTURAL ELEMENT FOR THERMAL INSULATION

[75] Inventors: Armin Schumacher, Rastatt; Gerhard Trunz, Bühlertal, both of Germany

[73] Assignee: Schoeck Bauteile GmbH, Baden-Baden, Germany

[21] Appl. No.: 801,289

[22] Filed: Feb. 18, 1997

Related U.S. Application Data

[63] Continuation of Ser. No. 353,479, Dec. 9, 1994, abandoned.

[30] Foreign Application Priority Data

Dec. 15, 1993 [DE] Germany ..... 43 43 673.5

[51] Int. Cl.[6] ..... E04B 1/78; E04B 1/41

[52] U.S. Cl. ..... 52/405.3; 52/259; 52/302.1; 52/432; 52/433

[58] Field of Search ..... 52/583.1, 432, 52/433, 259, 302.1, 405.3

[56] References Cited

U.S. PATENT DOCUMENTS

| | | | |
|---|---|---|---|
| 3,803,788 | 4/1974 | Artman | 52/583.1 |
| 4,959,940 | 10/1990 | Witschi | 52/583.1 |

FOREIGN PATENT DOCUMENTS

| | | | |
|---|---|---|---|
| 0121685 | 10/1984 | European Pat. Off. . | |
| 0150664 | 8/1985 | European Pat. Off. . | |
| 3005571 | 6/1981 | Germany . | |
| 4033505 | 4/1992 | Germany | 52/404.2 |
| 4302682 | 8/1994 | Germany . | |

OTHER PUBLICATIONS

English translation — "On Which Novelty of the ARBO–Cantilever Plate Connector Have You as Engineer Most Eagerly Awaited" Swiss Engineer & Architect, 1988.

*Primary Examiner*—Michael Safavi

*Attorney, Agent, or Firm*—Panitch; Schwarze; Jacobs & Nadel, P.C.

[57] ABSTRACT

A structural element for thermal insulation between two concrete structural components. An insulating body having metal reinforcing rods extending therethrough is to be attached to the concrete structural members with the rods extending within each member along either side of the insulating body. The rods running diagonally through the insulating body and extending along upper and lower edges of the insulating body so as to lie within upper and lower portions of the concrete structural members. Fire protection plates may be attached along upper and lower surfaces of the insulating body.

17 Claims, 11 Drawing Sheets

STRUCTURAL ELEMENT FOR THERMAL INSULATION

This application is a continuation of Ser. No. 08/353,479, filed Dec. 9, 1994, abandoned.

FIELD OF THE INVENTION

The invention pertains to a structural element for thermal insulation between two structural components to be covered in concrete, in particular between a building and a projecting external part, comprising an insulating body to be placed in between, with integrated metal tensile, compression, and transverse-force rods, which extend transverse to the insulating body and through it and on both sides into the structural components to be covered in concrete, whereby the transverse-force rods are bent in such a way that they run outwardly from the side of the building at a diagonal from above to below, through the insulating body, and then protrude in the region of the pressure zone in the direction toward the projecting external part to be covered in concrete.

BACKGROUND OF THE INVENTION

Structural elements of this type make it possible to join projecting concrete parts, in particular balcony or loggia plates, with the corresponding intermediate ceiling of a building, and to eliminate to the greatest extent possible the otherwise usual thermal bridges. As a result of this, they are becoming more and more prevalent in practice, and have in the meantime become known in numerous forms of implementation (DE-PS 3 005 571, EP-PS 121 685, and P 43 02 682).

In general, each insulating body has inserted into it a number of horizontal tension and compression rods that run through it and that are used to absorb the bending moment at the point of fixation, while the transverse-force rods have to extend from the building side at a diagonal from above to below all the way through the insulating body in order to take the weight of the projecting external parts. On the outside of the insulating body, they then continue to run horizontally, just like the tension and compression rods, in order to ensure a sufficient overlap with the connection reinforcements of the adjacent concrete structural components on both sides.

Up until now, these insulating bodies have been used only in such a manner that they are installed at the construction site in the region of the joint, and are possibly racked down with the connection reinforcement, after which the concreting of the two adjacent concrete structural components is carried out by means of site-mixed concrete.

SUMMARY OF THE INVENTION

The present invention is based on the recognition that the thermal separation, achieved by the structural elements under discussion, is desirable even when the structural components to be insulated from one another are not made of site-mixed concrete, but of factory-produced, prefabricated hollow body plates. The invention is therefore directed to the object of improving the known structural elements described at the beginning so that they are also suitable for connection with one or with two hollow body plates.

This object is solved in accordance with the invention for prefabricated hollow body plates with hollow spaces running perpendicular to the structural element, the hollow spaces being separated by means of intermediate webs, wherein the compression rods arranged in the lower region of the insulating body are extended on both ends in such a way that as a result of their anchoring length, they alternatively function as tension rods as well, and that the position of the tension, compression, and transverse-force rods in the insulating body is matched to the modular dimension of the intermediate webs of the hollow body plates.

The invention is based on the concept that the structural elements in accordance with the invention are not first constructed at the construction site, but earlier at the site of manufacture of the hollow body plates, therefore, they must be joined with the two adjacent concrete structural components. The structural elements are then, however, exposed to the risk, especially during transport and storage, that stresses will occur that they are not equipped to handle. In contrast with the pouring of site-mixed concrete, where the structural elements remain at the site, during transport of the hollow body plates that are equipped with the structural elements in accordance with the invention, completely different stresses can be involved than those associated with a stationary balcony plate. For this reason, in accordance with the invention, the compression rods arranged in the lower region of the insulating body are provided with an increased length on both sides in a way that was previously necessary only for the tension rods. Therefore, it no longer matters if positive or negative bending moments have to be transmitted during transport or storage.

Finally, as a result of the matching of the position of the reinforcing rods to the location of the intermediate webs of the hollow body plates, it is thus ensured that all of the reinforcing rods are enclosed by concrete and can fulfill their load-bearing function.

In a further development of the invention, it is advisable that at least partially, in place of the usual transverse-force rods, integrated in the insulating body are transverse-force rods running in a mirror-inverted manner that, starting from the side of the building, enter into the insulating body not from above, but from below, and then run through it diagonally toward the top. As a result of this, both of the load directions are covered equally with respect to the absorption of the transverse force.

Approximately the same number of transverse-force rods running normally and in mirror-inverted fashion are effectively arranged in the insulating body, in that the intermediate webs of the hollow body plates are alternately crossed by normal and by mirror-inverted transverse-force rods, whereby only one transverse-force rod is always provided per web.

In order to ensure a sufficient concrete covering of the transverse-force rods, they are preferably arranged in the center of the intermediate webs, while the tension and compression rods, which may run in the same intermediate web, are laterally displaced with respect to the center region.

In order to integrate the insulating bodies into the manufacturing process of the hollow body plates, the insulating bodies are provided with recesses that are located in a complementary position to the hollow spaces formed in the hollow body plates, and preferably in direct alignment with the hollow spaces. During the formation of the hollow body plates, removable displacers are used to form the hollow spaces. After the hollow body plate is formed the displacers are removed leaving open passages through the hollow body plate and the recesses in the insulating body. The recesses are closed off after the removal of the displacer with formed parts which can be inserted through the hollow space created by the displacers, or can be inserted into the insulating body from above, depending on the configuration of the insulating body. In the latter case, the insulating body is provided with openings which extend upwardly. The openings are closed off with appropriate shuttering elements to prevent concrete from entering the openings during formation of the hollow body plates.

For this reason it is recommended that insulating bodies having recesses with a closed circumference be utilized, with the recesses being approximately aligned with the hollow spaces in the hollow body plate. The recesses with a closed circumference can be sealed off with a simple cylindrically formed part. This formed part can comprise two pieces of a cylinder having a diagonal separating joint. Relative displacement of the parts along the separating joint causes a change in cross section such that the two parts can be inserted into the recesses through the hollow spaces in the hollow body plate, and then enlarged in cross section by such relative displacement to clamp the two parts into the recess of the insulating body.

An especially beneficial configuration of the invention is characterized by the fact that the insulating body has water drainage channels. As a result of this, it becomes possible to drain away, in a controlled manner, water that collects in the hollow spaces of the projecting hollow body plates as a result of seal defects in the balcony plate, so that this water does not force its way into the adjacent masonry or its plaster. At the same time, one can see that the seal, inside the balcony covering for example, is not correct. It is beneficial if the water drainage channels start from the recesses and extend to the lower end of the insulating body, where they can, if desired, be connected to collection pipes.

Instead of this, however, there also exists the possibility of allowing the water to flow all the way through the above-mentioned water drainage channels in the insulating body and into the hollow spaces of the hollow body plate at the side of the building. From there, it makes its way into the load-bearing walls where it evaporates with no problems. The passage of the water through the insulating body can also be brought about by means of the formed parts, that act as sealing plugs in the insulating body, being somewhat smaller than would correspond to the cross-section of the recesses in the insulating body. The clamping of the formed parts in the recesses is nevertheless ensured, because when the formed parts are pressed through the hollow spaces of the freshly poured hollow body plates, so much concrete mix collects in front of the formed parts that a local clamping in the recesses is ensured by virtue of this fact alone. This local clamping is not water-tight, of course, and thus allows the entry of any water that may be present through the recesses in the insulating body.

An alternative form of water drainage is also possible without the traversing of the insulating body, in which the projecting hollow body plate—beneficially at its free end—has drainage openings that proceed from its hollow spaces in a downward direction, and that empty, for example, into a drip molding.

An especially beneficial further development of the invention comprises the insulating body having a smaller installed height than the adjacent hollow body plates, that is, that the upper side of the insulating body is displaced somewhat downward with respect to the adjacent hollow body plates. This ensures that the screed plank which is run back and forth horizontally for leveling off the top of the hollow body concrete plate cannot damage the soft insulating body. Another favorable configuration comprises equipping the insulating body with fire protection plates at least on the bottom and, preferably, on the top as well. In order to take into account the difference in thermal loading, the lower fire protection plate is made thicker than the upper one such that it is approximately 15 to 25 mm thick while, by contrast, the upper one is only about 5 to 10 mm thick. In conjunction with this, it is beneficial if the upper fire protection plate is several mm or cm wider than the insulating body, so that it extends on both sides into the adjacent hollow body plates. This ensures that cracks, which frequently occur as a result of the tensile loading in the upper region between insulating bodies and the adjacent hollow body plates are covered in terms of fire protection.

Also with the type of insulating bodies equipped with fire protection plates, it is recommended that the insulating body, when encased in its fire protection plates, also be several mm lower than the adjacent hollow body plates.

BRIEF DESCRIPTION OF THE DRAWINGS

Additional features and advantages of the invention can be found in the following description of implementation examples with the aid of the drawing, wherein.

DETAILED DESCRIPTION OF PREFERRED EMBODIMENTS

Figure 1:
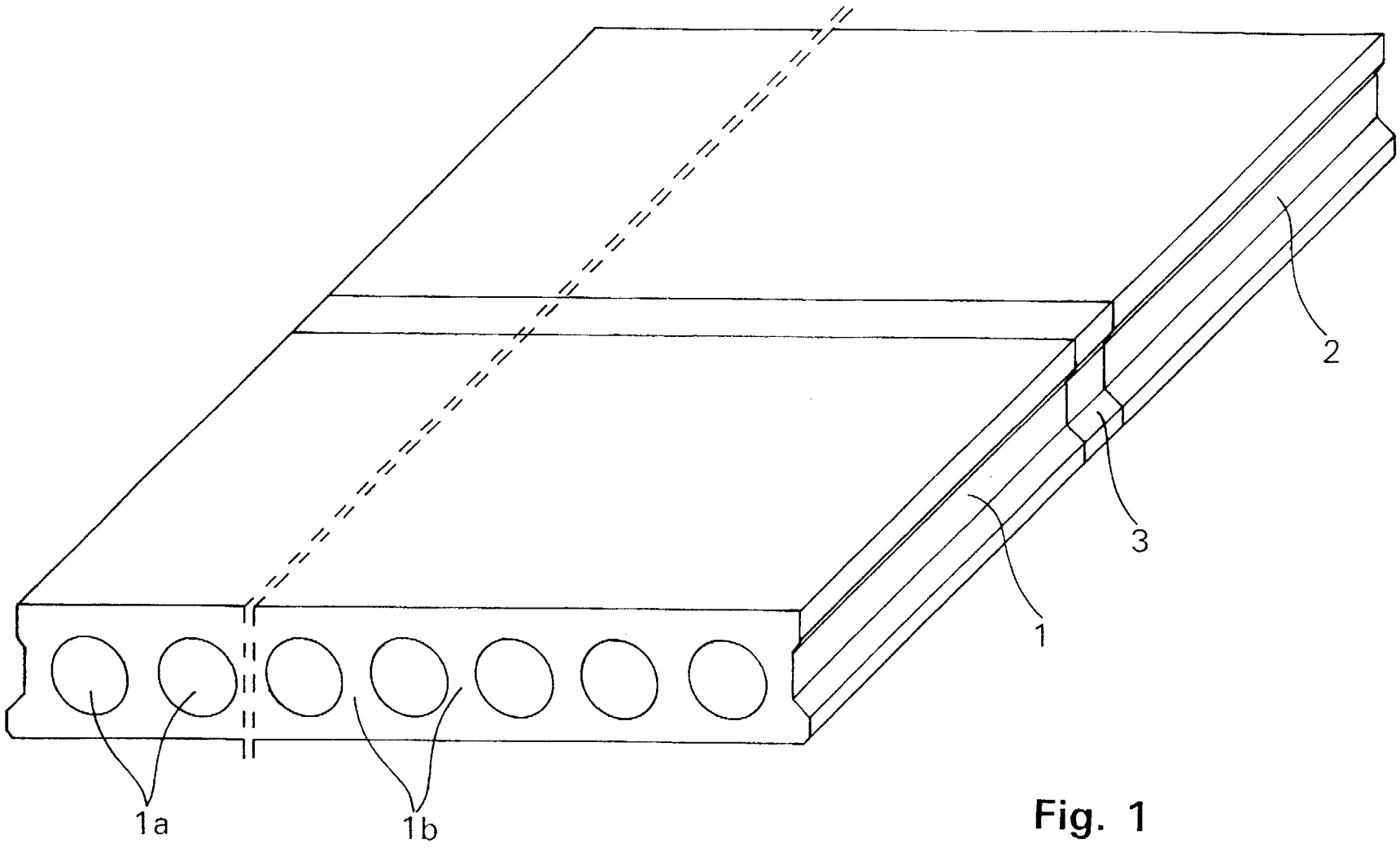
FIG. 1 is an oblique view of two concrete plates to be joined together by means of the structural element in accordance with the invention, at least one of which is a hollow body plate.

FIG. 1 shows two concrete plates 1 and 2, of which at least the front one, but normally the rear one as well, is configured as a hollow body plate. For this, they have, in a manner known per se, a row of parallel, cylindrical hollow spaces 1*a* running all the way through, each of which is separated from the others by means of intermediate webs 1*b*. Of course, the hollow spaces 1*a* can also be closed off at one of their ends or at both ends.

One of the two hollow body plates is to be used as a balcony or loggia plate in the structure to be erected, and, for that reason, is to be insulated from the other plates found in the interior of the building, in order to prevent or to minimize the flow of heat into the open air. It is for that purpose that the structural element 3 in accordance with the invention is built into the joint between the two plates 1 and 2. Its construction can be seen from the subsequent Figures.

Figure 2:
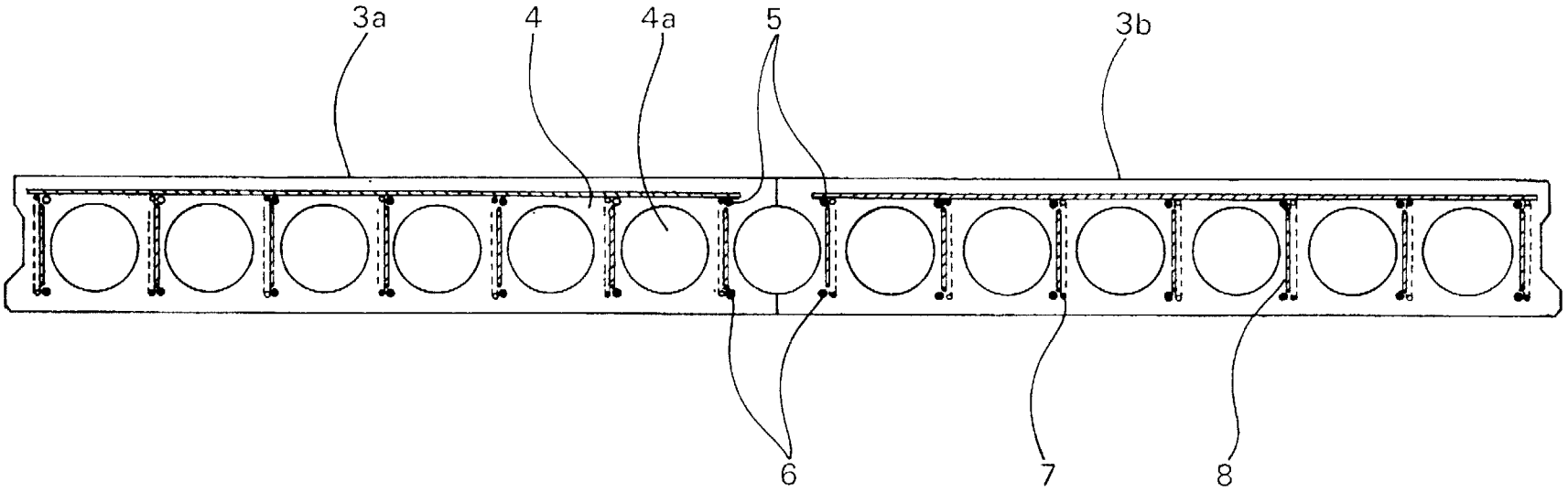
FIG. 2 is a front view of the structural element in accordance with the invention.

In accordance with FIG. 2, the structural element comprises, for easier handling, two halves 3*a* and 3*b*, which are essentially the same in their construction, namely an elongated insulating body 4, the height of which is matched to the wall thickness of the hollow body plates and the thickness of which amounts to 6 cm to 12 cm, depending upon the desired insulation. It is traversed horizontally by numerous cylindrical openings 4*a*, which align with the openings 1*a* of the adjacent hollow body plates.

In addition, in the insulating body 4, in the intermediate space between the above-mentioned openings, there are integrated a number of tension rods 5, and under them, the same number of compression rods 6. Each of the tension and compression rods 5, 6 run horizontally through the insulating body 4. In addition, there are also integrated into the insulating body transverse-force rods 7 and 7' that run diagonally along a vertical plane through the insulating body, but on the outside of which, each of them is bent to the horizontal, so that they run into the adjacent hollow body plates at about the height of the tension and compression rods.

Figure 4:
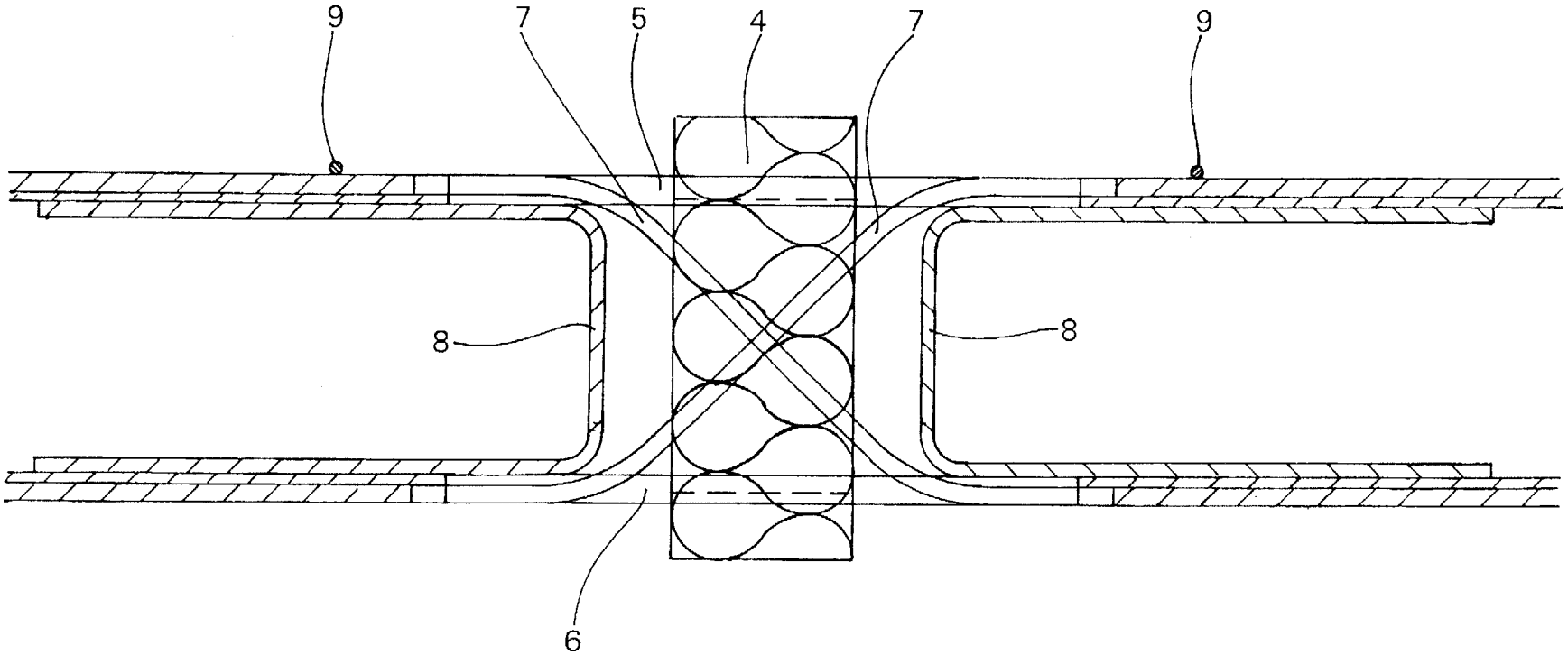
FIG. 4 is a cross-section through the structural element in accordance with FIG. 3.

It is fundamental, as can be seen particularly clearly in FIG. 4, that the compression rods 6 are dimensioned in such a way, and also have an anchoring length in the adjacent concrete structural components, that they also function as tension rods and can absorb approximately the same tensile stresses as the tension rods 5. In the same way, the transverse-force rods 7 alternate with transverse-force rods 7' arranged in mirror-inverted fashion, so that they can absorb the transverse forces in both vertical directions.

Figure 3:
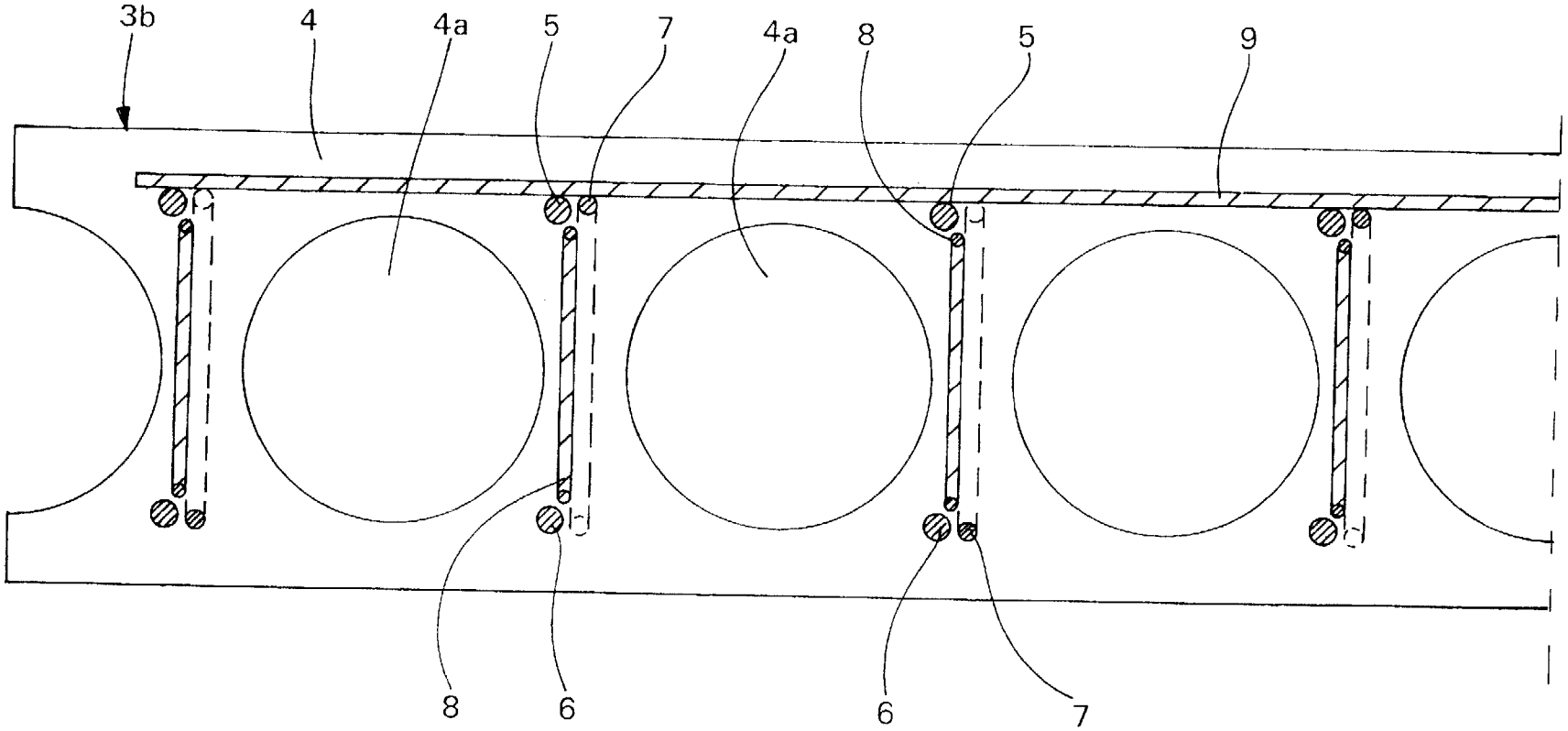
FIG. 3 is an enlargement of a portion of FIG. 2.

Since, where they exit from the insulating body, the transverse-force rods run closer to the hollow spaces 1*a* than the tension and compression rods, it is recommended that they be arranged as centered as possible to the concrete webs 1*b*, and that, for this purpose, the tension and compression rods be displaced somewhat to the side, as is shown in FIG. 3.

In addition, each of the tension and/or compression and/or transverse-force rods is welded to a U-shaped stirrup 8 outside of the insulating body. This has the advantage that these stirrups no longer have to be manually positioned and joined to the neighboring reinforcing rods by means of racking wire as was the case previously. Finally, the tension rods can in addition be joined by means of transverse mounting rods 9 (FIG. 3).

In this manner, to each intermediate web 1*b* in the hollow body plate there is allocated one tension rod 5, one compression rod 6, one transverse-force rod 7, and one stirrup 8. However, it is, of course, within the realm of the invention that, in installation situations with low loading, the reinforcement need only be provided in every second intermediate web 1*b*, or the intermediate webs may be equipped alternately with tension and compression rods only, along with the stirrups or only with transverse-force rods, respectively.

Figure 4A:
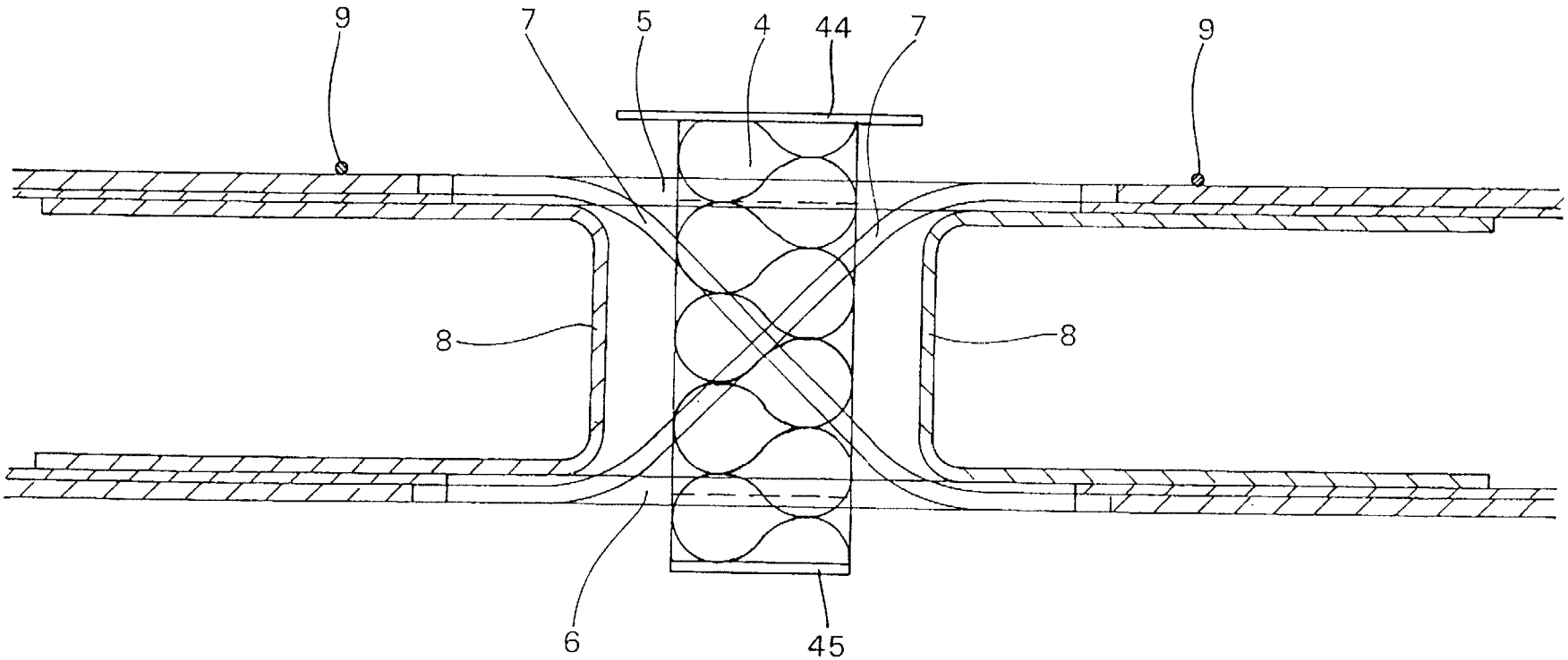
FIG. 4*a* is a cross-section similar to FIG. 4.

FIG. 4*a* shows practically the same insulating body as FIG. 4. It is just configured somewhat shorter, and is instead equipped on the upper side with a fire protection plate 44 and on the lower side with a fire protection plate 45, which can, for example, be made of a glass-fiber reinforced light-weight plate. The fire protection plate 44 extends beyond the width of the insulating body 4 on both sides, in order also to shield possible cracks that result from the tensile stress between the insulating body and the adjacent concrete structural components, which as a rule is not necessary in the case of the fire protection plate 45 which is arranged lower down in the pressure region. Instead, the latter is made somewhat thicker.

Figure 5:
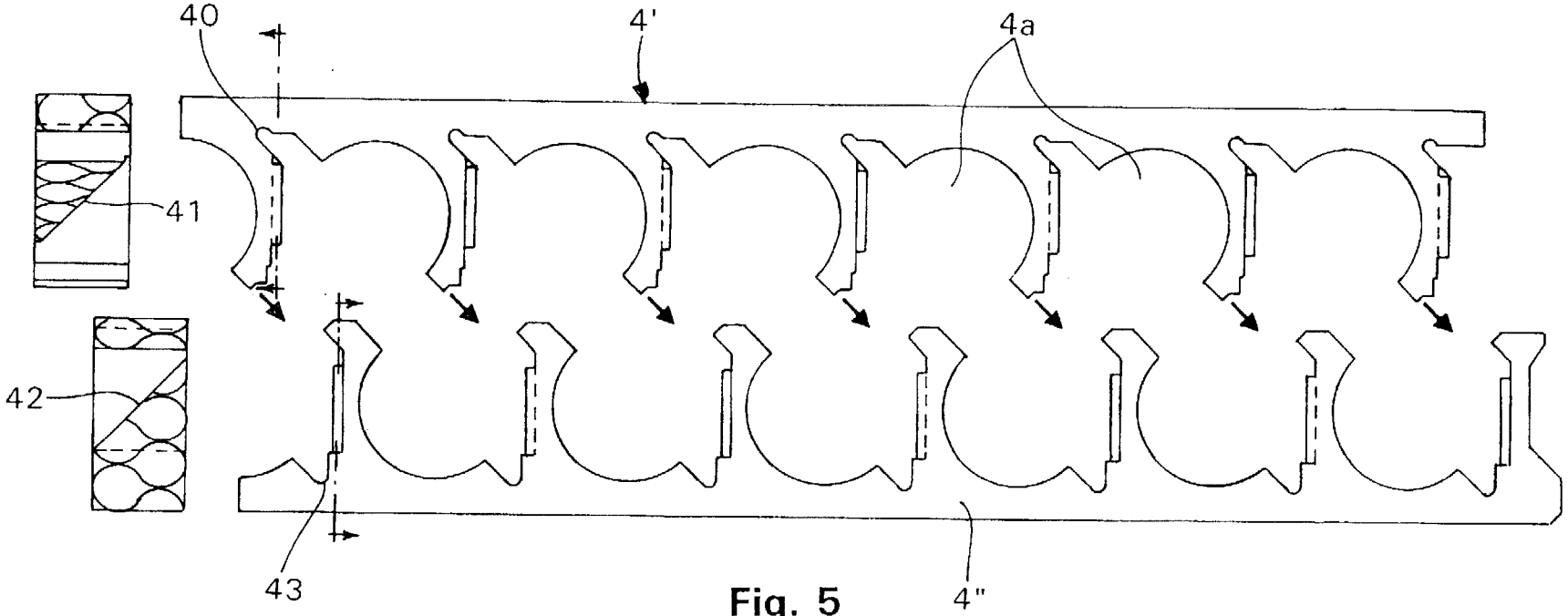
FIGS. 5 and 6 show an insulating body to be assembled from three parts.

FIG. 5 shows that the insulating body 4 is assembled from two nearly mirror-image partial pieces 4' and 4". The separating joint between the two partial pieces is laid out in such a way that all regions of the insulating body, in which the reinforcing rods run, are contacted. Thus, in the upper partial piece 4' there are recesses 40 for the tension rods and recesses 41 for the transverse-force rods, and in the lower partial piece 4" recesses 42 for the transverse-force rods and 43 for the compression rods, each of which corresponds with corresponding mating surfaces of the other partial piece. As a result, all of the reinforcing rods can easily be positioned in a transverse direction, and thus do not need to be pushed through the insulating body for the entire length, and following the assembly of the two partial pieces 4' and 4", they are reliably fixed into position by means of the mating surfaces that correspond with each other.

Figure 6:
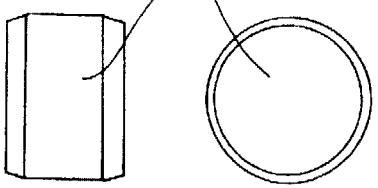

FIG. 6 shows a sealing plug 10, in the front view and side view, which is used for closing off the openings 4*a* in the insulating body. It is dimensioned in such a way that it is held in the openings by clamping.

Figure 7:
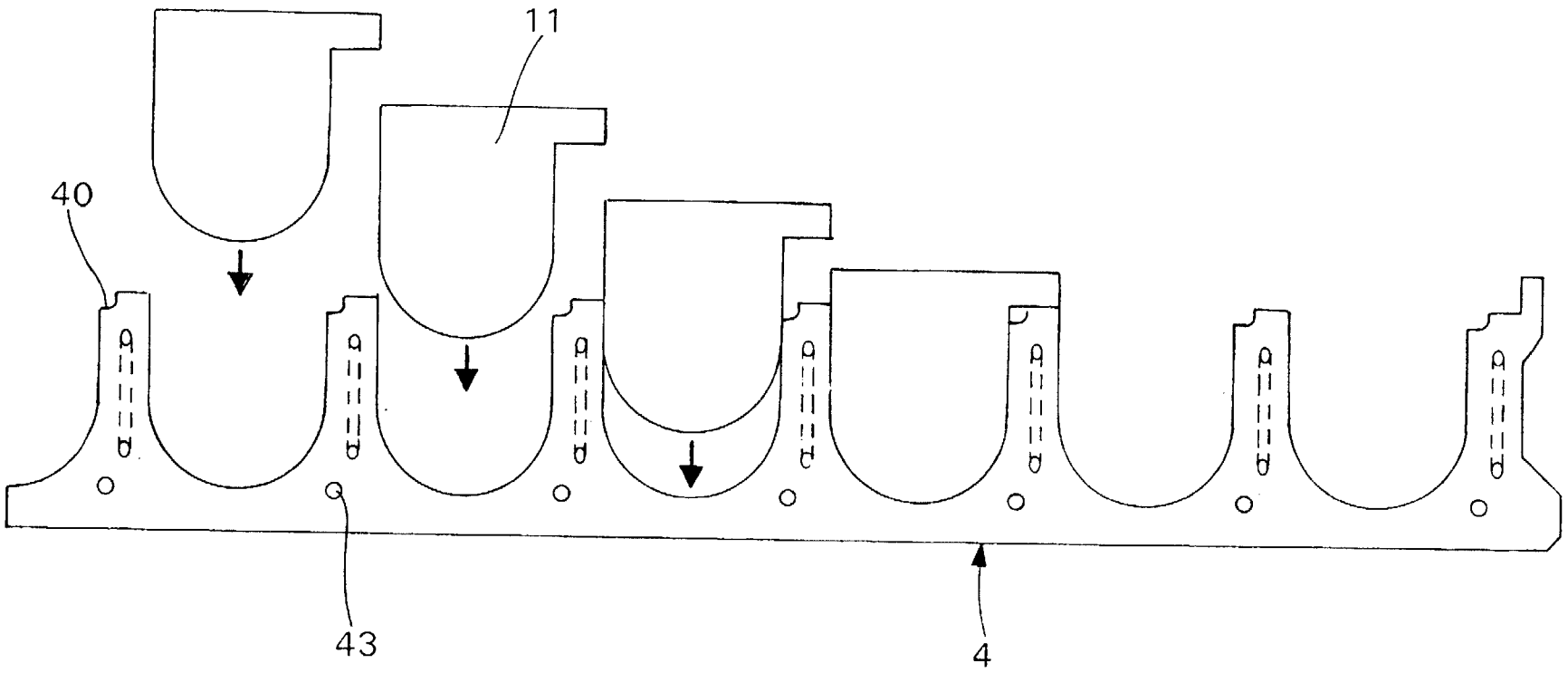
FIG. 7 is an insulating body to be assembled from two parts.

FIG. 7 shows another alternative for closing off the openings. Here, the openings 4*a* are at first open to the top and are then closed off by means of a fitting insert 11 that has an approximately U-shaped contour. In conjunction with this, during the pouring of the concrete plates 1 and 2 the region of the insulating body that is later to be closed off by means of the inserts 11 must be occupied by a matching form piece that leaves only the openings 4*a* free. Following sufficient solidification of the concrete and the pulling of the displacers, this form piece is removed, and in place of it the insulating body is completed by means of the inserts 11.

Figure 8:
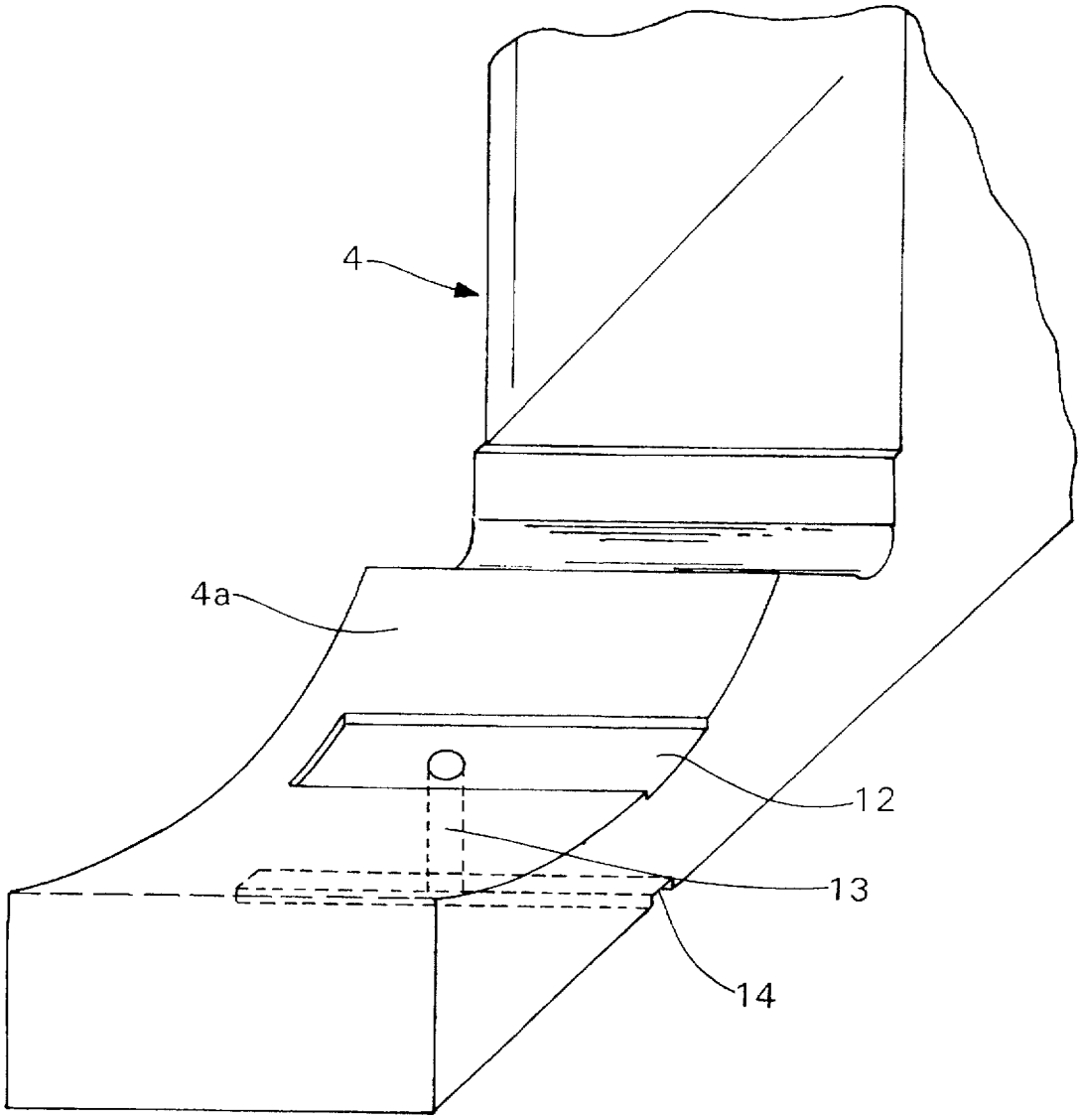
FIG. 8 is an enlargement of a portion in the region of the drainage channel.
Figure 9A:
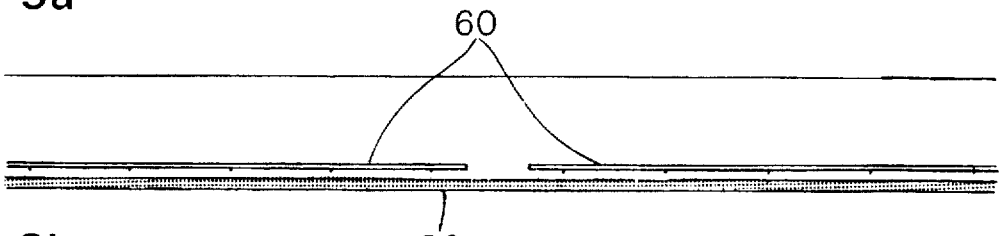
FIG. 9 shows the manufacturing steps for two hollow body plates joined together by means of the structural element in accordance with the invention.
Figure 9B:
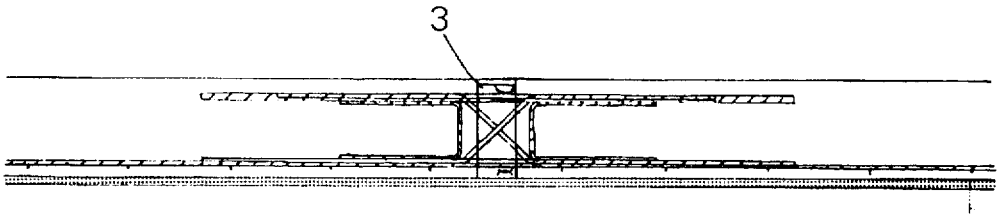
Figure 9C:
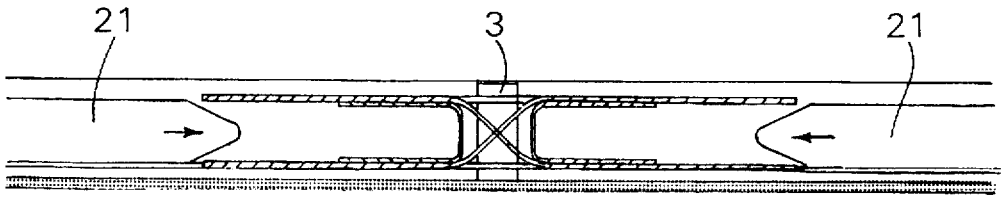
Figure 9D:
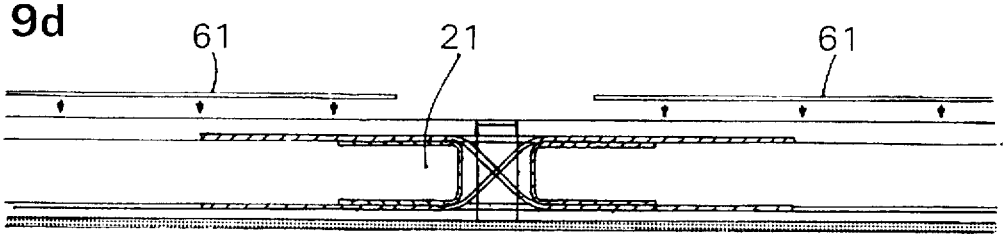
Figure 9E:
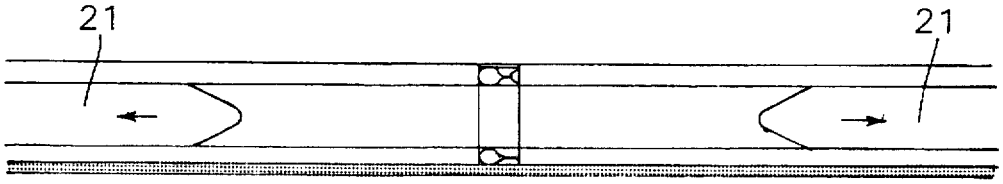
Figure 9F:
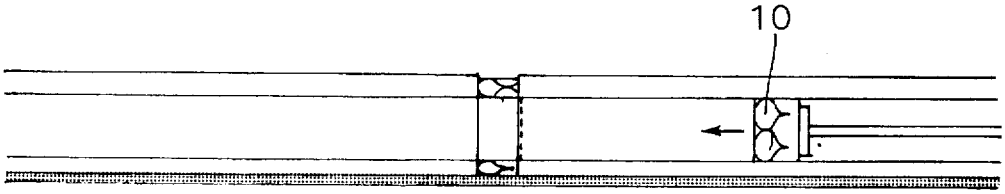

In FIG. 8 it can be seen that the insulating body has in the lower region of its opening 4*a* a drainage trough 12 that is open towards the projecting concrete structural component and that leads downward via a channel 13 and to the outside via an additional pipe 14. Of course, this drainage system can be connected to a collecting pipe for the corresponding drainage channels from the remaining openings of the insulating body, and possibly further empty into a special drain.

FIG. 9 shows schematically the production of two hollow body plates that are joined together by means of a structural element in accordance with the invention. In this regard, on a pallet 20 surrounded on all sides by edge rests which correspond to the dimensions of the concrete plates and are not shown in detail, lower reinforcing layers 60 for the concrete structural components 1 and 2 are first placed at a prescribed distance from one another. The structural element 3 in accordance with the invention is then brought into the region of the joint, and its lower reinforcing rods are racked down with the reinforcing layers 60 of the two concrete structural components (FIG. 9*b*). Inserted from one side, or alternately from both sides, are displacers 21, in conjunction with which the insulating body 4 is placed with respect to them in such a way that these displacers traverse the insulating body along the openings 4*a* (FIGS. 9*c* and 9*d*). If, instead of this, displacers are being used that run only to the insulating body or to just in front of it, then the openings 4*a* in the insulating body can, of course, be dispensed with.

Finally, the laying of the upper reinforcing layers 61 is carried out, which are joined with the upper reinforcing rods of the insulating body (FIG. 9*d*), and the pouring of the concrete can begin.

Once the concrete has hardened sufficiently, the displacers 21 are again withdrawn (FIG. 9*e*), and the openings 4*a* in the insulating body are closed off by means of sealing plugs 10, so that the heat transfer from convection can be prevented.

If an especially good clamping of the sealing plug 10 in the insulating body is to be achieved, then the structural design in accordance with FIG. 10 is recommended. In this regard, the sealing plug is divided along a diagonal plane 10*a* into two preferably equal halves 10*b* and 10*c*. If these partial pieces are displaced from their aligned position, this will result in a reduction of their overall height, as a result of which they can be more easily pushed into the opening 4*a* of the insulating body. By means of the subsequent pushing together of both of the partial pieces in accordance with the lower drawing in FIG. 10, the installed height is increased, thus yielding a tightly sealed clamping.

Finally, FIG. 10 shows, in addition, that the sealing plug 10 bears, in its lower region, a recess 10*d* that corresponds with the water drainage trough 12 of the insulating body and makes the drainage easier. This has special importance whenever concrete chips and similar things in the hollow spaces 1*a* in the concrete plates have to be taken into account, as a result of which a smaller drainage cross-section could become plugged.

Figure 11:
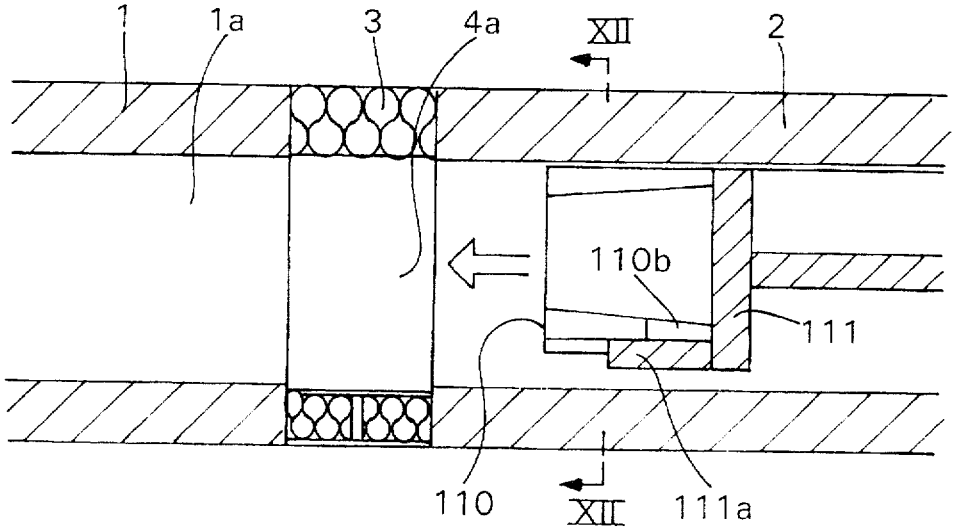
FIGS. 11 through 13 show a different version of the closing off.
Figure 12:
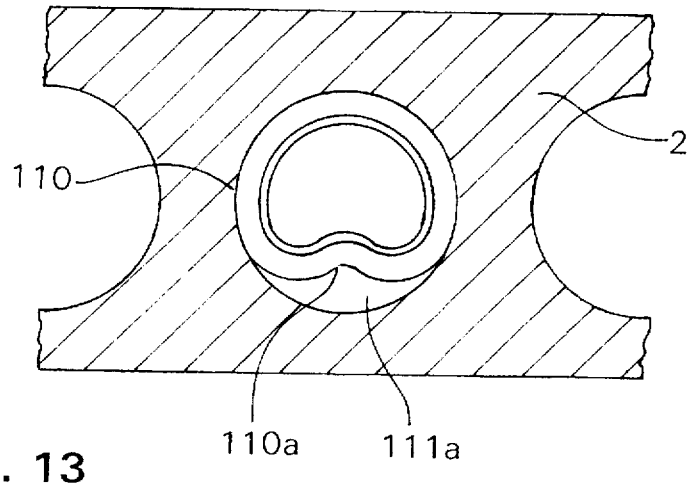
Figure 13:
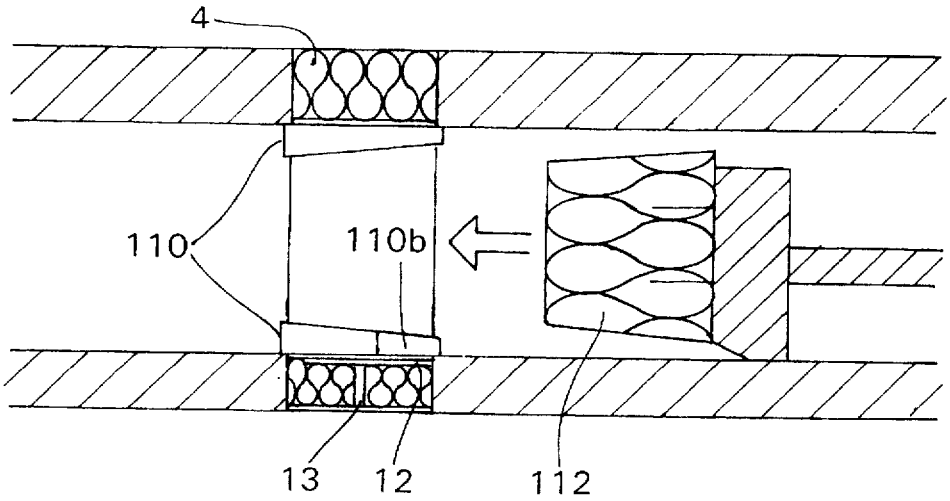

FIGS. 11 through 13 show another variation for closing off the openings 4*a* in the insulating body. In this regard, a radially flexible ring 110 is used that is indented to the inside at one part of its circumference. This indentation 110*a* is maintained by means of a corresponding shape 111 of the press that is used for pushing it in. As a result of this indentation, the ring 110 can be pressed through the hollow space 1*a* of the adjacent hollow body plate without abrasion, even though in its relaxed state it has a circumference greater than that of the hollow space 1*a*. The ring 110 is thus pressed in its indented state into the recess 4*a* by the press 111, and is there brought into its relaxed state in which it is no longer indented. This can take place by means of the fact that the lower part 111*a* of the press 11, which is responsible for the indentation, is withdrawn, as a result of which the ring 110 is automatically relaxed towards the outside and is clamped in the recess 4*a* of the insulating body.

In conjunction with this, in accordance with FIG. 13 and by means of a similar press a conical sealing plug 112 is inserted into the ring 110 and clamped there. The ring 110 can be cylindrical or it can be conical as well. It is fundamental that the ring 110 has in its lower region, similar to the sealing plug shown in FIG. 10, a recess 110*b* located on one side or on both sides that makes possible the drainage of water from the hollow spaces 1*a* or 2*a* to the water drainage trough 12 of the insulating body.

In addition, it can be seen in FIG. 13 that the press exhibits on its front side a number of projecting needles that bear the sealing plug 112. As a result of this, the sealing plug cannot turn during insertion, which has importance if it has drainage recesses in its lower region. As a rule, during this insertion procedure, so much concrete mix material is carried along by the sealing plug and by the press that the sealing plug, even if it does not have a conical design, clamps sufficiently into the insulating body and retains its position in the insulating body during the withdrawal of the press. In order that the insertion travel of the press is neither too short not too long, it is recommended that it have at its rear end a limit stop. In addition, an "up/down" marking can be applied there if it makes a difference whether the sealing plug is inserted at the correct angle because of a water drainage recess.

By way of summary, the invention is thus distinguished by its optimum suitability for hollow body plates.

We claim:

1. A structural element for use in providing thermal insulation between two prefabricated concrete hollow body plates (1, 2) having hollow spaces (1*a*) extending perpendicular to the structural element (3), the hollow spaces being separated by intermediate webs (1*b*), the structural element (3) comprising an insulating body (4) having upper and lower regions and first and second opposite sides, the insulating body being adapted for location between the concrete body plates and having tensile, compression, and transverse-force rods (5, 6, 7) which extend transverse to the insulating body (4) and are adapted to be positioned in the two concrete hollow body plates (1, 2), the transverse-force rods (7) being provided in a first group and a second group, each transverse-force rod in the first group including first and second parallel portions which are parallel to and offset from each other, the first parallel portion of each of the transverse-force rods in the first group extending outwardly from the upper region on the first side of the insulating body and the second parallel portion of each of the transverse-force rods in the first group extending outwardly from the lower region on the second side of the insulating body, the first and second parallel portions being connected by a diagonal portion which extends through the insulating body (4), each transverse-force rod in the second group including first and second parallel portions which are parallel to and offset from each other, the first parallel portion of each of the transverse-force rods in the second group extending outwardly from the lower region on the first side of the insulating body and the second parallel portion of each of the transverse-force rods in the second group extending outwardly from the upper region on the second side of the insulating body, the first and second parallel portions of each of the transverse-force rods in the second group being connected by a diagonal portion which extends through the insulating body (4), such that the second group of the transverse-force rods is arranged in a mirror-inverted manner to the transverse-force rods in the first group, the tension rods being arranged in the upper region of the insulating body and having an anchoring length, the compression rods (6) being arranged in the lower region of the insulating body (4) and have an anchoring length which is sufficient to make the compression rods function as tension rods as well, the tension, compression, and transverse-force rods (5, 6, 7) in the insulating body (4) being located at a selected spacing, the selected spacing being adapted to correspond with a position of the intermediate webs (1*b*), the insulating body (4) having recesses (4*a*) that are adapted to be located in complementary positions to the hollow spaces (1*a*) of adjacent hollow body concrete plates, insertable form parts (10, 110, 112) being located in the recesses (4*a*) in the insulating body, and the form parts (10) comprise two parts (10*b*, 10*c*) displaceable along diagonal surfaces (10*a*).

2. A structural assembly comprising two prefabricated concrete hollow body plates and a structural element (3) located between the two prefabricated concrete hollow body plates (1, 2) for providing thermal insulation between the concrete body plates, the two prefabricated concrete hollow body plates having hollow spaces (1*a*) extending perpendicular to the structural element (3) and sides adjacent to the structural element, the hollow spaces being separated by intermediate webs (1*b*), the structural element (3) including an insulating body (4) having upper and lower regions and first and second opposite sides, the insulating body being located between the concrete body plates and having integrated tensile, compression, and transverse-force rods (5, 6, 7), which extend transverse to the insulating body (4) and into the sides of the two concrete hollow body plates (1, 2), the transverse-force rods (7) being provided in a first group and a second group, each transverse-force rod in the first group including first and second parallel portions which are parallel to and offset from each other, the first parallel portion of each of the transverse-force rods in the first group extending outwardly from the upper region on the first side of the insulating body and the second parallel portion of each of the transverse-force rods in the first group extending outwardly from the lower region on the second side of the insulating body, the first and second parallel portions being connected by a diagonal portion which extends through the insulating body (4), each transverse-force rod in the second group including first and second parallel portions which are parallel to and offset from each other, the first parallel portion of each of the transverse-force rods in the second group extending outwardly from the lower region on the first side of the insulating body and the second parallel portion of each of the transverse-force rods in the second group extending outwardly from the upper region on the second side of the insulating body, the first and second parallel portions of each of the transverse-force rods in the second group being connected by a diagonal portion which extends through the insulating body (4), such that the second group of the transverse-force rods is arranged in a mirror-inverted manner to the transverse-force rods in the first group, the tension rods being arranged in the upper region of the insulating body and having a first anchoring length, the compression rods (6) being arranged in the lower region of the insulating body (4) and have a second anchoring length which is sufficient to make the compression rods function as tension rods as well, and the tension, compression, and transverse-force rods (5, 6, 7) in the insulating body (4) are located in a position to correspond with a position of the intermediate webs (1*b*).

3. Structural element in accordance with claim 2, characterized in that there are approximately the same number of transverse-force rods (7, 7') in the first and second groups located in the insulating body (4).

4. Structural element in accordance with claim 3, characterized in that the transverse-force rods (7, 7') from the first and second groups are arranged in an approximately alternating fashion in the insulating body (4).

5. Structural element in accordance with claim 2, characterized in that the transverse-force rods (7, 7') are positioned in the insulating body and are located in a complementary position to a vertical center region of the intermediate webs (1*b*).

6. Structural element in accordance with claim 2, characterized in that the tension and compression rods (5, 6) are positioned in the insulating body and are located in a complementary position to an area adjacent to a center region of the intermediate webs (1*b*).

7. Structural assembly in accordance with claim 2, characterized in that one hollow body plate (1 or 2) has drainage bores that intersect the hollow spaces (1*a*).

8. Structural assembly in accordance with claim 2, wherein the hollow body plates have a first height, and the insulating body (4) has a smaller height than the adjacent hollow body plates (1, 2).

9. Structural element in accordance with claim 2, characterized in that the insulating body (4) has a top and a bottom, and includes a fire protection plate (44, 45) on one of the top and bottom.

10. Structural element in accordance with claim 9, characterized in that fire protection plates (44, 45) are located on the top and the bottom of the insulating body, and the bottom fire protection plate is thicker than the top fire protection plate (44).

11. Structural element in accordance with claim 9, having a top fire protection plate (44) which is wider than the insulating body (4) for extending into the adjacent hollow body plates (1, 2) on both sides.

12. Structural element in accordance with claim 9, wherein fire protection plates (44, 45) are located on the top and bottom of the insulating body, and the insulating body (4) has a lower height which is adapted to be approximately 3 to 6 mm lower than adjacent hollow body plates (1, 2).

13. A structural element for use in providing thermal insulation between two prefabricated concrete hollow body plates (1, 2) having hollow spaces (1*a*) extending perpendicular to the structural element (3), the hollow spaces being separated by intermediate webs (1*b*), the structural element (3) comprising an insulating body (4) having upper and lower regions and first and second opposite sides, the insulating body being adapted for location between the concrete body plates and having tensile, compression, and transverse-force rods (5, 6, 7) which extend transverse to the insulating body (4) and are adapted to be positioned in the two concrete hollow body plates (1, 2), the transverse-force rods (7) being provided in a first group and a second group, each transverse-force rod in the first group including first and second parallel portions which are parallel to and offset from each other, the first parallel portion of each of the transverse-force rods in the first group extending outwardly from the upper region on the first side of the insulating body and the second parallel portion of each of the transverse-force rods in the first group extending outwardly from the lower region on the second side of the insulating body, the first and second parallel portions being connected by a diagonal portion which extends through the insulating body (4), each transverse-force rod in the second group including first and second parallel portions which are parallel to and offset from each other, the first parallel portion of each of the transverse-force rods in the second group extending outwardly from the lower region on the first side of the insulating body and the second parallel portion of each of the transverse-force rods in the second group extending outwardly from the upper region on the second side of the insulating body, the first and second parallel portions of each of the transverse-force rods in the second group being connected by a diagonal portion which extends through the insulating body (4), such that the second group of the transverse-force rods is arranged in a mirror-inverted manner to the transverse-force rods in the first group, the tension rods being arranged in the upper region of the insulating body and having an anchoring length, the compression rods (6) being arranged in the lower region of the insulating body (4) and have an anchoring length which is sufficient to make the compression rods function as tension rods as well, the tension, compression, and transverse-force rods (5, 6, 7) in the insulating body (4) being located at a selected spacing, the selected spacing being adapted to correspond with a position of the intermediate webs (1*b*), the insulating body (4) having recesses (4*a*) that are adapted to be located in complementary positions to the hollow spaces (1*a*) of adjacent hollow body concrete plates, and insertable form parts (10, 110, 112) being located in the recesses (4*a*) in the insulating body.

14. Structural element in accordance with claim 13, characterized in that the form parts (10, 110, 112) are clamped in the recesses (4*a*).

15. Structural element in accordance with claim 13, characterized in that the insulating body (4) has water drainage channels (12, 13, 14), and the form parts (10, 110, 112) have recesses (10*d*, 110*b*) in the region of the water drainage channels (12, 13).

16. A structural element for use in providing thermal insulation between two prefabricated concrete hollow body plates (1, 2) having hollow spaces (1*a*) extending perpendicular to the structural element (3), the hollow spaces being separated by intermediate webs (1*b*), the structural element (3) comprising an insulating body (4) having upper and lower regions and first and second opposite sides, the insulating body being adapted for location between the concrete body plates and having tensile, compression, and transverse-force rods (5, 6, 7) which extend transverse to the insulating body (4) and are adapted to be positioned in the two concrete hollow body plates (1, 2), the transverse-force rods (7) being provided in a first group and a second group, each transverse-force rod in the first group including first and second parallel portions which are parallel to and offset from each other, the first parallel portion of each of the transverse-force rods in the first group extending outwardly from the upper region on the first side of the insulating body and the second parallel portion of each of the transverse-force rods in the first group extending outwardly from the lower region on the second side of the insulating body, the first and second parallel portions being connected by a diagonal portion which extends through the insulating body (4), each transverse-force rod in the second group including first and second parallel portions which are parallel to and offset from each other, the first parallel portion of each of the transverse-force rods in the second group extending outwardly from the lower region on the first side of the insulating body and the second parallel portion of each of the transverse-force rods in the second group extending outwardly from the upper region on the second side of the insulating body, the first and second parallel portions of each of the transverse-force rods in the second group being connected by a diagonal portion which extends through the insulating body (4), such that the second group of the transverse-force rods is arranged in a mirror-inverted manner to the transverse-force rods in the first group, the tension rods being arranged in the upper region of the insulating body and having an anchoring length, the compression rods (6) being arranged in the lower region of the insulating body (4) and have an anchoring length which is sufficient to make the compression rods function as tension rods as well, the tension, compression, and transverse-force rods (5, 6, 7) in the insulating body (4) being located at a selected spacing, the selected spacing being adapted to correspond with a position of the intermediate webs (1*b*), the insulating body (4) having recesses (4*a*) that are adapted to be located in complementary positions to the hollow spaces (1*a*) of adjacent hollow body concrete plates, insertable form parts (10, 110, 112) being located in the recesses (4*a*) in the insulating body, and the form parts comprise a radially flexible sealing ring (110), particularly inwardly indentable and a plug (112) insertable therein.

17. A structural element for use in providing thermal insulation between two prefabricated concrete hollow body plates (1, 2) having hollow spaces (1*a*) extending perpendicular to the structural element (3), the hollow spaces being separated by intermediate webs (1*b*), the structural element (3) comprising an insulating body (4) having upper and lower regions and first and second opposite sides, the insulating body being adapted for location between the concrete body plates and having tensile, compression, and transverse-force rods (5, 6, 7) which extend transverse to the insulating body (4) and are adapted to be positioned in the two concrete hollow body plates (1, 2), the transverse-force rods (7) being provided in a first group and a second group, each transverse-force rod in the first group including first and second parallel portions which are parallel to and offset from each other, the first parallel portion of each of the transverse-force rods in the first group extending outwardly from the upper region on the first side of the insulating body and the second parallel portion of each of the transverse-force rods in the first group extending outwardly from the lower region on the second side of the insulating body, the first and second parallel portions being connected by a diagonal portion which extends through the insulating body (4), each transverse-force rod in the second group including first and second parallel portions which are parallel to and offset from each other, the first parallel portion of each of the transverse-force rods in the second group extending outwardly from the lower region on the first side of the insulating body and the second parallel portion of each of the transverse-force rods in the second group extending outwardly from the upper region on the second side of the insulating body, the first and second parallel portions of each of the transverse-force rods in the second group being connected by a diagonal portion which extends through the insulating body (4), such that the second group of the transverse-force rods is arranged in a mirror-inverted manner to the transverse-force rods in the first group, the tension rods being arranged in the upper region of the insulating body and having an anchoring length, the compression rods (6) being arranged in the lower region of the insulating body (4) and have an anchoring length which is sufficient to make the compression rods function as tension rods as well, the tension, compression, and transverse-force rods (5, 6, 7) in the insulating body (4) being located at a selected spacing, the selected spacing being adapted to correspond with a position of the intermediate webs (1*b*), the insulating body (4) having water drainage channels (12, 13, 14) and recesses (4*a*) that are adapted to be located in complementary positions to the hollow spaces (1*a*) of adjacent hollow body concrete plates, and the water drainage channels (12, 13, 14) are located between the recesses (4*a*) and the lower region of the insulating body (4).

* * * * *

UNITED STATES PATENT AND TRADEMARK OFFICE

CERTIFICATE OF CORRECTION

PATENT NO. : 5,799,457

DATED : 9/1/98

INVENTOR(S) : Schumacher

It is certified that error appears in the above-identified patent and that said Letters Patent is hereby corrected as shown below:

Column 4, line 39, replace "Figure 9 shows" with --Figures 9a-9f show--.

Figure 10A:
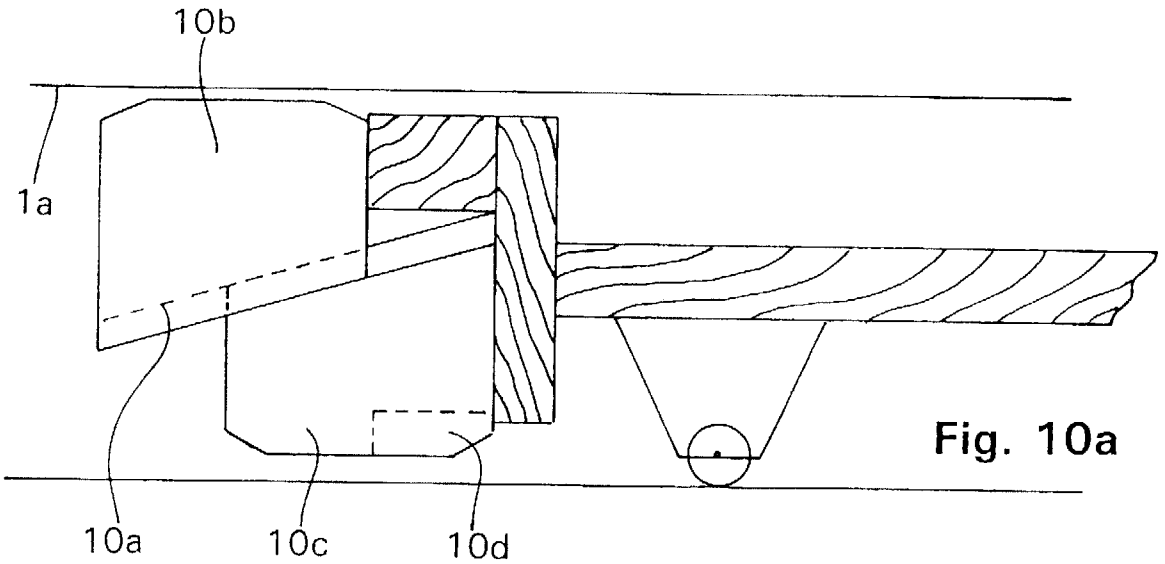
FIG. 10 shows the closing off of the openings in the insulating body.
Figure 10B:
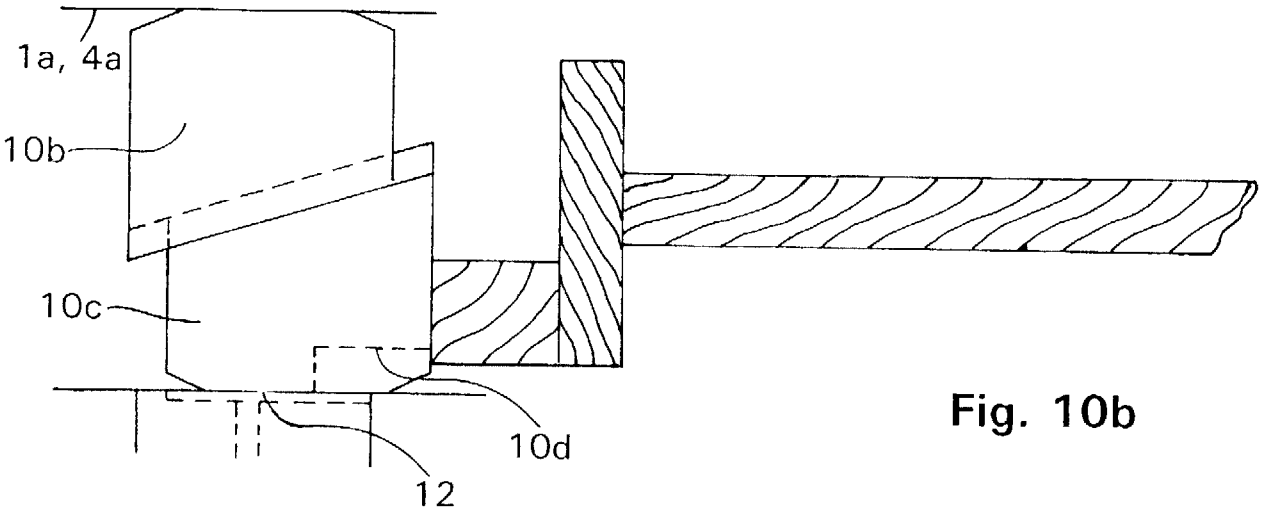

Column 4, line 42, replace "Figure 10 shows" with --Figures 10a and 10b show --.

Column 6, line 41, replace "Figure 9 shows" with --Figures 9a-9f show--.

Column 7, line 3, replace "Figure 10" with --Figures 10a and 10b--.

Column 7, line 13, replace "Figure 10 shows" --Figures 10a and 10b show--.

Signed and Sealed this

Twenty-third Day of February, 1999

*Attest:*

Q. TODD DICKINSON

*Attesting Officer*

*Acting Commissioner of Patents and Trademarks*